United States Patent [19]

Dassler

[11] 4,375,728

[45] Mar. 8, 1983

[54] SOLE MADE OF RUBBER OR OTHER ELASTIC MATERIAL FOR SHOES, ESPECIALLY SPORTS SHOES

[75] Inventor: Armin A. Dassler, Herzogenaurach, Fed. Rep. of Germany

[73] Assignee: Puma - Sportschuhfabriken Rudolf Dassler KG, Herzogenaurach, Fed. Rep. of Germany

[21] Appl. No.: 167,033

[22] Filed: Jul. 9, 1980

[30] Foreign Application Priority Data

Jul. 9, 1979 [DE] Fed. Rep. of Germany ..... 2927704

[51] Int. Cl.[3] ..... A43B 13/04; A43B 13/22; A43C 15/00

[52] U.S. Cl. ..... 36/32 R; 36/59 C; 36/114; D2/317

[58] Field of Search ..... 36/32 R, 59 R, 59 A, 36/59 C, 67 A, 114, 128, 129, 28, 29, 134; D2/317

[56] References Cited

U.S. PATENT DOCUMENTS

| | | | |
|---|---|---|---|
| 1,011,110 | 5/1911 | Brown | 36/59 A |
| 3,043,025 | 7/1962 | Semon | 36/59 C |
| 3,063,171 | 11/1962 | Hollander | 36/134 X |
| 3,463,165 | 8/1969 | Goodman | 36/67 A |
| 3,932,950 | 1/1976 | Taber | 36/32 R |
| 4,011,666 | 3/1977 | Lehmann | 36/59 C |
| 4,083,125 | 4/1978 | Benseler et al. | 36/32 R |
| 4,180,923 | 1/1980 | Dassler | 36/59 C |
| 4,223,459 | 9/1980 | Riggs | 36/59 C |
| 4,319,412 | 3/1982 | Muller et al. | 36/59 C |

FOREIGN PATENT DOCUMENTS

| | | | |
|---|---|---|---|
| 2828561 | 1/1980 | Fed. Rep. of Germany | 36/32 R |
| 52-26941 | 2/1977 | Japan | 36/32 R |

OTHER PUBLICATIONS

Runner's World, vol. 13, No. 10, Oct. 1978, pp. 124–125, 178–179.

*Primary Examiner*—James Kee Chi
*Attorney, Agent, or Firm*—Antonelli, Terry & Wands

[57] ABSTRACT

A sole made of rubber or other elastic material for shoes especially sport shoes, having a tread with studs or cleats distributed at least on part of the tread with at least some of the studs or cleats being inclined relative to the tread as the studs or cleats formed with a plurality of arms at least some of which extend at an angle of about 30°–120° with respect to each other and form an angle of about 10°–85° with respect to a base surface of the tread. According to some embodiments, the arms of the studs or cleats are of equal length, while in other embodiments the arms of the studs or cleats are of unequal length. Additionally, some embodiments extend at different angles with respect to the base surface of the sole or are formed of cleats having differing numbers and/or shapes of the arms of the tread. In some embodiments, the arms of the cleats are themselves provided with a tread of seven different possible types. Furthermore, in accordance with yet another embodiment, the stud or cleat arms are hollow and are provided with a valved passage for setting the pressure within the hollow of the stud or cleat arms.

30 Claims, 13 Drawing Figures

SOLE MADE OF RUBBER OR OTHER ELASTIC MATERIAL FOR SHOES, ESPECIALLY SPORTS SHOES

BACKGROUND AND SUMMARY OF THE INVENTION

The invention relates to a sole made of rubber or other elastic material for shoes, especially sports shoes, with studs or cleats distributed on at least part of a tread of the sole, at least some of which are inclined relative to the tread.

Soles of this type are known from German Gebrauchsmuster (Utility Model) 1,634,279. In these known soles only edge projections on both sides thereof are inclined relative to the sole surface, so that on load application and resulting curvature of the sole, the treads of the edge projections move into the same plane as the other projections to provide for a degree of protection from skid. It has been demonstrated however that such expedients do not provide for sufficient grip, especially lateral stability, in consideration of the versatility of the use of sports shoes on some very different surfaces.

Therefore, the object of the invention is to improve soles of the above-disclosed type so as to provide a high degree of slip resistance, sole elasticity, and lateral stability even on different deck surfaces, and especially on hard surfaces, such as asphalt streets or roads where sufficient shock absorption must be obtained in order to protect the runner from excessive strain.

According to the invention this object is achieved in a sole with studs or cleats at least some of which are inclined relative to the tread of the sole by constructing the studs of cleats with plural arms at least some of which extend at an angle of about 30°–120° with respect to each other and form an angle of about 10°–85° with the base of the tread.

The multiple-arm structure of the studs or cleats, and their inclination relative to the sole base provide for a sufficient shock-absorbing effect even when the stud material is relatively hard and therefore wear resistant. This condition applies even when there is no intermediate sole between the sole and the insole, or said intermediate sole is thinner than normal in known sports shoes. Another feature of a shoe, especially a sports shoe, provided with with a sole in accordance with the invention is that it is relatively light in weight in comparison to conventional shoes as the intermediate sole must extend over a very large portion of the total sole surface and thus a reduction in its thickness or elimination thereof has a significant effect.

The multiple-arm studs or cleats are extensible in the manner of a shock absorber also and results in excellent lateral stability, which is particularly advantageous when running along curves in sports competition. Additionally, due to the shock-absorberlike extensibility of the multiple-arm studs or cleats, the angle between said arms and the angle between the arms and the sole varies on load application and release, so that dirt particles cannot be retained in the wedge-shaped recesses formed between the arms. Therefore, the sole of the invention provides for a definite self-cleaning effect.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
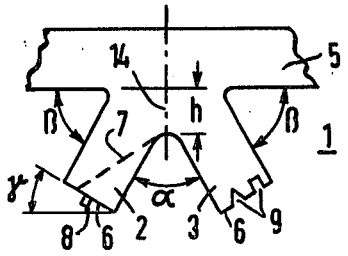
FIG. 1 is an elevation of a two-arm stud or cleat on an exaggerated scale.
Figure 2:
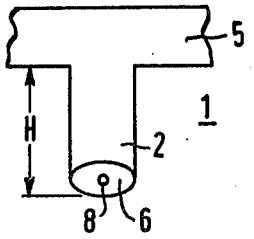
FIG. 2 is a side view after 180° rotation.

FIGS. 1 and 2 represent a single stud or cleat 1 comprising an intermediate portion 14 and two cylindrical arms 2 and 3 As can be seen in the drawings, intermediate portion 14 connects arms 2 and 3 with each other and with the sole base 5. The arms 2 and 3 diverge with respect to each other at an angle $\alpha$ of about 60° and, with the base of the sole 5, form an angle $\beta$ also of 60°. These angles may vary to a relatively large extent in accordance with the hardness of the stud material, the length of the arms, the arm cross section, or similar parameters. In particular, the variation range of angle $\alpha$ is between 30° and 120°, and that of angle $\beta$ between 10° and 85°.

In this embodiment the angle $\gamma$, which determines the inclination of the tread 6 of arms 2 and 3 to the horizontal or base surface, is equal to about 30° and can vary by about ±15° depending on the intended application. Arms 2 and 3 can also be tapered as indicated by the broken line 7 in FIG. 1 to obtain a conical stud arm. Provisions of the above-described type permit a control of the elasticity of studs or cleats 1, and therefore adaptation to individual requirements. Thus, the stud elastically depends on the material used, but is determined primarily by shape features such as type or length of the studs and the angle α between stud arms provided for improved shock absorption.

Figure 3:
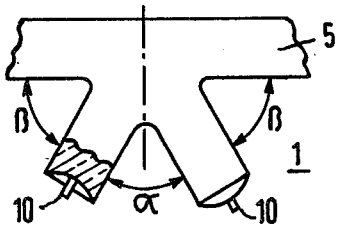
FIG. 3 is an elevation also in an exaggerated scale of a two-arm stud or cleat, one arm exhibiting a concave base surface, the other arm a convex base surface.

As shown in FIGS. 1 and 2, the tread 6 of arms 2 and 3 can be provided with knoblike projections 8 or recesses 9 of different cross sectional shape further to improve the grip of studs or cleats 1. For the same purpose the tread may be concave as shown on the left side of FIG. 3, or convex as shown on the right side of FIG. 3, and provided with a pinlike projection 10.

Figure 4:
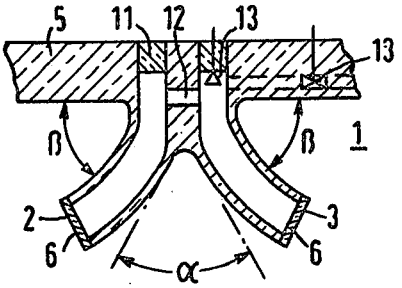
FIG. 4 is a section on an exaggerated scale through a two-arm stud or cleat comprising hollow, outward extending arms seen in elevation.

In the embodiment of FIG. 4 the free ends of arms 2 and 3 are bent outward. To obtain a considerable reduction in the weight of the shoe provided with such a sole, arms 2 and 3 may be hollow and filled with a pressure medium. A plug 11 serves as closure. In another advantageous embodiment at least some of the hollow arms are interconnected by an internal or surface system of passages 12, and said arms can be supplied with pressure medium through a valvelike element 13. In this embodiment, depending on the base surface conditions, the arm elasticity can be regulated in small steps by adjusting the internal pressure of the pressure medium.

Figure 5:
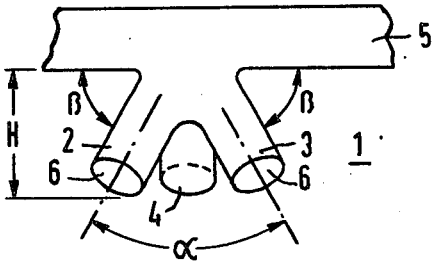
FIG. 5 is a front view on an exaggerated scale of a three-arm stud or cleat.
Figure 7:
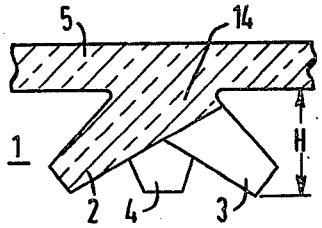
FIG. 7 is a section on a greatly exaggerated scale of a three-arm stud or cleat with arms in the form of cone frustums seen in elevation.
Figure 6:
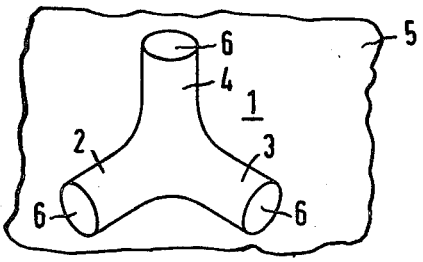
FIG. 6 is a bottom view of the base of a sole provided with the stud or cleat of FIG. 5.

FIGS. 5 and 6 illustrate an embodiment with a three-arm stud or cleat 1 whose inclined arms 2, 3, and 4 are cylindrical to provide studs or cleats 1 that are steady and skid resistant in all directions and permit a relatively large torsional angle when the elasticity is suitably determined. The latter also applies to the embodiment of FIG. 7 in which arms 2, 3, and 4 are in the form of cone frustums whose larger bases are connected to sole 5 by an intermediate portion 14. In many cases intermediate portion 14 can be omitted since the contact surface area can be sufficiently large because of the inclined position of the arms.

Figure 8:
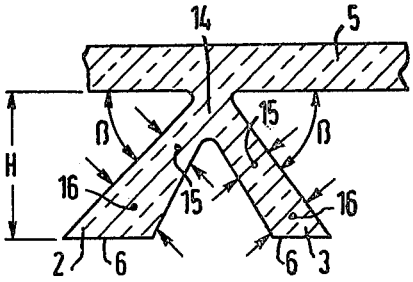
FIG. 8 is a section on an exaggerated scale through a two-arm stud or cleat with conical arms seen in elevation, the larger cone-frustum bases merging with the arm tread.

FIG. 8 represents a two-arm stud or cleat 1 in which the two arms 2 and 3 are also in the form of cone frustums. In contrast to the embodiment of FIG. 7, in this arrangement, the smaller cone-frustum surfaces 15 merge into intermediate portion 14, and the larger cone-frustum surfaces 16 are continued by arm tread 6. Again arm treads 6 can be tapered (not shown) so as to lie flush on the deck surface. The two conical arms may be of equal size, but may be of different dimensions as shown in FIG. 8. Therefore, the elasticity of the studs or cleats can be adapted to different applications.

Figure 9:
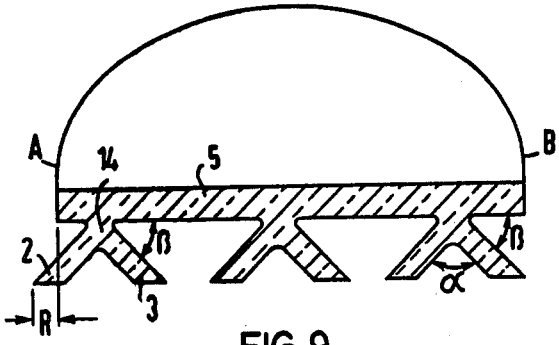
FIG. 9 is a schematic cross section through a shoe with two-arm studs or cleats with arms projecting from the outer edge.

FIG. 9 is a schematic cross section through a shoe comprising a sole 5 whose outer edge is designated by A and inner edge by B. To increase the shoe tread surface area the outer arm 2 of the outer left stud is arranged so that its free end extends beyond upper or sole edge A. In the present case, arm 2 projects from edge A by a distance R. In the extreme case distance R can be determined so that the left edge of intermediate portion 14 is flush with the outer edge A of sole 5.

In applications where the largest possible tread surface area is desired the arm ends located along inner edge B can also extend beyond said edge B, but then the projecting distance R must be shorter than in the case of outer edge A.

Figure 10:
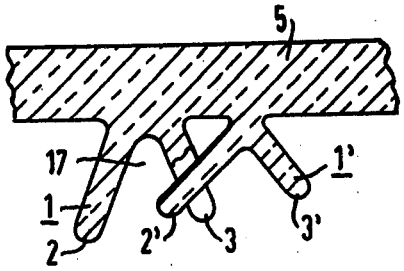
FIG. 10 is a perspective view on an exaggerated scale of the arrangement of two multiple-arm studs or cleats, in which one of the arms extends in the direction of or into the recess formed by the two arms of the adjacent stud or cleat.

FIG. 10 is a perspective view of the arrangement of two two-arm studs or cleats 1 and 1'. The two arms 2 and 3 of stud or cleat 1 form a recess 17 into which at least part of the arm 2' of stud or cleat 1' projects. This provides for the advantage of a strong self-cleaning effect since dirt particles which may have become stuck in recess 17 are forced out or at least loosened by arm 2' moving toward recess 17 when a load is applied to sole 5.

Figure 11:
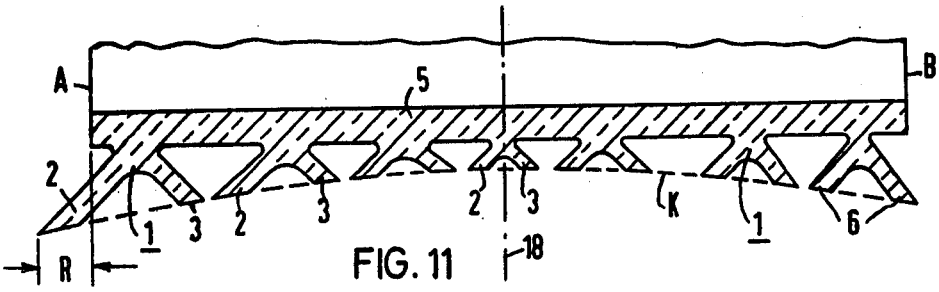
FIG. 11 is a cross section through a sole with asymmetric arms, the longest arms being located at the sole edge and the shortest arms in the zone extending along the sole longitudinal axis.

FIG. 11 represents a sole 5 provided with studs or cleats 1 carrying arms 2 and 3 of different length and whose treads 6 extend along a line K which is convex relative to the base surface. Instead of extending along a curved line K arm treads 6 can extend along the side of an obtuse angle whose vertex should be near the longitudinal median plane 18 of the sole. A sole as in FIG. 11 is characterized by especially strong shock absorption because of the shock-absorberlike extension of studs or cleats 1, which is further improved by resilience.

Figure 12:
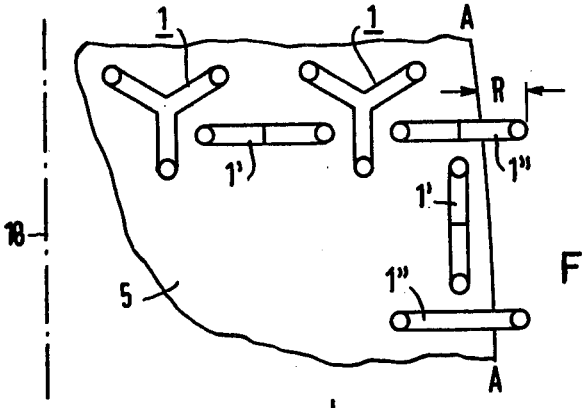
FIG. 12 is a view of the tread of a portion of a sole provided with studs or cleats having different arms.

FIG. 12 represents a portion of a sole seen in the direction toward the tread of sole 5 which is provided with a variety of studs or cleats 1, and the row arrangement of exclusively two-arm studs or cleats 1 can be utilized with advantage. In the embodiment illustrated in FIG. 12, three-arm studs or cleats are designated by numeral 1 and two-arm studs by numeral 1'. The latter extend perpendicularly to the longitudinal median plane 18 of the sole and are combined with edge studs or cleats 1'' projecting by a distance R.

Figure 13:
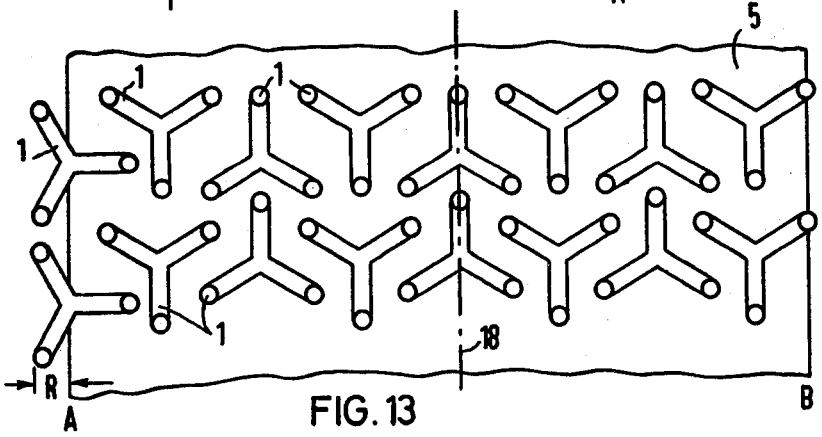
FIG. 13 represents a sole with rows of three-arm studs or cleats.

In the embodiment of FIG. 13, three-arm studs or cleats 1 are aligned in the direction of sole longitudinal axis 18 and in the direction perpendicular thereto. Two of the three-arm studs or cleats 1 are used as an edge arm at the edge A of the sole to provide for an extremely large tread area and therefore a high degree of skid resistance and steadiness.

For reasons of strength the height h of intermediate portion 14 should be at least 1–2 mm. The height H of stud arm 2, 3, or 4 is preferably 3–15 mm.

Studs or cleats 1 form preferably an integral unit, but it is basically feasible in the case of soles produced by casting to place studs or cleats 1 separately in the mold, and to recast them with the sole material.

When studs or cleats 1' are arranged in parallel rows perpendicular to sole longitudinal median plane 18, the studs or cleats 1 of two adjacent rows are preferably staggered to prevent the mutual interference of studs or cleats 1 when the stud arms extend outward under load.

The sole of the invention is especially suitable to long-distance running in all kinds of difficult terrains, especially to cross-country running, but can be used also with great advantage for trimming, jogging, and training purposes of diverse types.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A sole for running shoes made of rubber or other material having elastic properties, comprising a sole base having a plurality of resiliently flexible cleats projecting outwardly from an outer surface thereof, at least some of said cleats being formed of arms which are connected to each other and to said outer surface of the sole base by an intermediate portion of the cleat, said arms extending away from said sole base in directions diverging from said intermediate portion relative to each other and forming an acute angle with respect to said sole base.

2. A sole as in claim 1, wherein said arms diverge at an angle of about 30°–120° with respect to each other and form an angle of about 10°–85° with respect to said outer surface of the sole base.

3. A sole as in claim 2, characterized in that the arms of at least some of the cleats are of unequal length.

4. A sole as in claim 1, wherein a tread surface of the arms of at least some of the cleats are oriented parallel to said outer surface of the sole base.

5. A sole as in claim 2, characterized in that the cleats are of equal length.

6. A sole as in claim 1 or 2 or 5, wherein the arms of at least some of the cleats are of equal length.

7. A sole as in claim 6, characterized in that the arms of the cleats are of at least some of unequal length.

8. A sole as in claim 2 or 5 or 7, characterized in that the arms of at least some of the cleats extend at different angles from the outer surface of the sole base.

9. A sole as in claim 6, characterized in that the arms of at least some of the cleats extend at different angles from the outer surface of the sole base.

10. A sole as in claim 8, characterized in that the shape of the cross section of the cleats is geometrically rounded, in a circular or elliptical manner.

11. A sole as in claims 2 or 5 or 3, characterized in that the shape of the cross section of the cleats is polygonal.

12. A sole as in claim 11, characterized in that the cleats are of elongated form.

13. A sole as in claims 2 or 5 or 3, characterized in that the arms of the cleats are curved.

14. A sole as in claim 13, characterized in that the arms of the cleats are curved so that their treads are oriented outward.

15. A sole as in claim 2, characterized in that the cross sectional area of the cleats is larger on a side opposite the base of the sole than on a side adjacent to the base of the sole.

16. A sole as in claim 2, characterized in that the arms of the cleats are in the form of a cone or cone frustum, the base surface thereof merging into an arm tread.

17. A sole as in claim 1 or 2, characterized in that the cleat arms are provided with a tread that is provided with knob shaped projections.

18. A sole as in claim 1 or 2, wherein the cleat arms are provided with a tread having pinlike projections.

19. A sole as in claim 2, characterized in that the cleat arms are provided with tread having recesses.

20. A sole as in claim 2, characterized in that the cleat arms have a tread that is concave.

21. A sole as in claim 2, characterized in that the cleat arms have a tread that is convex.

22. A sole as in claims 2 or 5 or 3, characterized in that at least one arm of the cleats is hollow.

23. A sole as in claim 13, characterized in that at least one arm of the cleats is hollow.

24. A sole as in claim 22, characterized in that at least one arm of the multiple-arm cleats is provided with a valvelike element.

25. A sole as in claim 22, characterized in that at least some of the hollow cleat arms are interconnected in groups by passages, each group being provided with only one valvelike element.

26. A sole as in claim 2, characterized in that at least part of said sole is provided with multiple-arm cleats of different length extending across the entire sole width, the longest studs or cleats being located at the sole edges, and the shortest thereof along the sole longitudinal median plane.

27. A sole as in claims 2 or 26, characterized in that cleat arms located near the edge of the sole extend beyond the sole edge.

28. A sole as in claim 27, characterized in that at least part of said sole is provided with cleats comprising different numbers of arms.

29. A sole as in claim 2, characterized in that at least part of said sole is provided with cleats comprising different numbers of arms.

30. A sole as in claim 2 or 3, characterized in that adjacent multiple-arm cleats are relatively arranged so that one free arm end of one cleat is movable on load application to the sole in the direction of a recess formed between the arms of an adjacent cleat.

* * * * *